US005174136A

United States Patent [19]

Thwing

[11] Patent Number: 5,174,136

[45] Date of Patent: Dec. 29, 1992

[54] DUAL FUNCTION PADLOCK WITH REMOVABLE CYLINDER MECHANISM

[76] Inventor: Randy L. Thwing, 2408 Western Ave., Las Vegas, Nev. 89102

[21] Appl. No.: 771,650

[22] Filed: Oct. 4, 1991

[51] Int. Cl.[5] ..... E05B 67/22; E05B 11/00

[52] U.S. Cl. ..... 70/38 A; 70/51; 70/371; 70/389; 70/379 R

[58] Field of Search ..... 70/371, 369, 368, 367, 70/38 A, 51, 374, 389, 379 R, 370, DIG. 62

[56] References Cited

U.S. PATENT DOCUMENTS

| | | | |
|---|---|---|---|
| 1,636,381 | 7/1927 | Megie et al. . | |
| 2,213,262 | 9/1940 | Segal | 70/379 R |
| 2,433,114 | 12/1947 | Gray | 70/367 |
| 2,460,615 | 2/1949 | Andrew | 70/369 |
| 2,557,028 | 6/1951 | Deutsch | 70/369 |
| 3,143,872 | 8/1964 | Check | 70/38 A |
| 3,172,279 | 3/1965 | Patriquin | 70/38 |
| 3,404,549 | 10/1968 | Best | 70/370 |
| 3,728,879 | 4/1973 | Best | 70/38 |
| 3,788,111 | 1/1974 | Parlier | 70/364 |
| 3,793,856 | 2/1974 | Lippisch | 70/368 |
| 3,882,699 | 5/1975 | Flack et al. | 70/38 |
| 4,068,510 | 1/1978 | Neary | 70/379 |
| 4,112,715 | 9/1978 | Uyeda | 70/38 |
| 4,138,868 | 2/1979 | Richards | 70/38 |
| 4,290,280 | 9/1981 | Yun | 70/38 |
| 4,419,873 | 12/1983 | Sopko | 70/38 |
| 4,576,026 | 3/1986 | Kurt et al. | 70/380 |
| 4,663,953 | 5/1987 | Fish et al. | 70/380 |
| 4,763,496 | 8/1988 | Evans et al. | 70/38 |
| 4,776,187 | 10/1988 | Evans et al. | 70/38 A |
| 4,793,166 | 12/1988 | Marks | 70/379 |
| 4,998,422 | 3/1991 | Borgmann et al. | 70/367 |

OTHER PUBLICATIONS

1987 Article from Locksmith Ledger Magazine, pp. 46–49.

Two sheets of drawings (undated) showing features of a padlock that has been on sale by Applicant.

Best Lock Corporation catlaog dated 1989, p. 4.19

*Primary Examiner*—Lloyd A. Gall

*Assistant Examiner*—D. Boucher

*Attorney, Agent, or Firm*—John Edward Roethel

[57] ABSTRACT

A padlock with removable cylinder mechanism offers the user a choice of two distinct manners of operation or "functions"—a Key Retaining function and a Non-Key Retaining function. This dual function capability in a single unit is achieved by a rotator bolt bored to allow placement of a pattern of pins. A series of pins, which when installed in the rotator bolt in a specified pattern, causes the function selection to be accomplished. A re-keyable padlock which accepts widely available, standard dimensioned, generic key operated lock cylinders allowing the keying of this padlock to be adapted to the wide range of keying systems used in locks found in residential, commercial and other uses as required for security and convenience. The use of standard dimensioned cylinders in the padlock is accomplished by a cylinder retainer, tailpiece stop and rotator bolt which adapts the generic cylinder to padlock use. The cylinder retainer, which retains the lock cylinder in the padlock body, is in turn held in the body by a threaded screw which is accessible through the short shackle leg opening in the body only when the shackle is in the unlocked condition and swung clear of its body opening. Upon removal of the threaded screw, the cylinder retainer and lock cylinder are removed from the body and the cylinder can be serviced or replaced.

12 Claims, 8 Drawing Sheets

DUAL FUNCTION PADLOCK WITH REMOVABLE CYLINDER MECHANISM

This invention relates to a padlock, and more specifically to a padlock with a key operated, removable cylinder mechanism which allows the user a choice of a key retaining function or a non-key retaining function in a single padlock.

BACKGROUND OF THE INVENTION

Typical key operated padlocks are manufactured to operate in one of two distinct manners or "functions": a non-key retaining function and a key retaining function.

In a padlock designed to have non-key retaining ("NKR") function, the key may be removed while the padlock is unlocked. The padlock may then be locked at any time by pushing the shackle into the padlock body, allowing the padlock mechanism to automatically lock the padlock. This padlock, therefore, does not "retain" the key while the padlock is unlocked.

In a padlock designed to have a key-retaining ("KR") function, the padlock mechanism prevents the key from being removed from the padlock while the padlock is unlocked. The padlock mechanism allows the key to be removed only when the padlock shackle is returned to the locked position in the padlock body. This padlock, therefore, "retains" the key while the padlock is unlocked.

There are practical, functional and security requirements for both functions. Heretofore, users of padlocks, after determining their padlock function requirements, would then procure padlocks of the appropriate function. Manufacturers produce padlocks of one function or the other to fulfill these various user requirements. This causes manufacturers, lock-smiths and padlock suppliers to stock double inventories of padlocks, one set of NKR padlocks and one set of KR padlocks, to satisfy padlock user needs.

Situations arise where an unauthorized person obtains control of the key to a padlock or a master key for a series of padlocks, or has a duplicate key made surreptitiously, so that he is able, at his convenience, to open the padlock or padlocks and gain unauthorized entry to the building or compartment protected by the padlock. In other instances, it may be desirable that a padlock be operated by the same key that is used for other locks on residential, commercial, industrial, government and military buildings or compartments. In this case it is necessary to remove the present cylinder from the padlock and insert into the padlock body a new cylinder of the type required to meet the new keying specification. In all these situations, it is necessary to remove the cylinder from the padlock for servicing or replacement. All of such situations are conveniently provided for by the present improved dual function padlock with removable cylinder mechanism.

Typical prior art padlock patents show examples of single function padlocks, in either a NKR or KR design. U.S. Pat. No. 3,882,699 discloses a non-key retaining function padlock. U.S. Pat. No. 4,112,715 to Uyeda discloses a key-retaining function padlock. U.S. Pat. No. 4,290,280 to Yun discloses a non-key retaining function padlock. U.S. Pat. No. 4,138,868 to Richards discloses a single function, non-key retaining only padlock.

The prior art as a body discloses no padlock structure in which dual function capability is accomplished. There is a need in the art for a padlock that is formed to accept generic cylinders, the cylinders being of a design and type readily available and produced by manufacturers to standard dimensions commonly found in residential and commercial applications and adaptable to all keyways and keying systems in general use, but allowing dual function selection in a single padlock.

It is an object of the present invention to provide a single padlock in which the required function can be selected at the time of installation. Thus, it would no longer be necessary for padlock suppliers to stock two separate inventories of padlocks, one in a NKR function and one in a KR function, as is currently necessary to provide the choice of the particular function required by padlock users.

It is an advantage of the present invention that by providing a padlock with a removable key-actuated cylinder mechanism of a generic type, the owner of the padlock or a technician may, for reasons of security or convenience, change the key, remove the cylinder mechanism to repair the same, convert one or a group of padlocks to various keying specifications replace the cylinder in the padlock with another cylinder providing for a key change, or perform work on the padlock which involves a change or repair of the cylinder or padlock mechanism.

It is a further object of the present invention to provide a dual function, removable cylinder, re-keyable padlock of such structure as to accept and be operated by an s unlimited variety of standard dimensioned, generic lock cylinders produced by manufacturers of locks and keying systems.

It is a further object of the present invention to provide a padlock with dual function capability, whereby a padlock supplier would no longer have to stock two distinct padlock models to fulfill customer needs. One padlock of the dual function type would replace the previous two product lines, with obvious cost savings. By having a dual function padlock, where either the non-key retaining function or the key retaining function could be easily selected at the time of installation by means of a simple arrangement of interior parts, the padlock supplier could fulfill customer requirements, while vastly reducing inventory, resulting in lower costs to both the supplier and the customer.

Manufacturers of locks and keying systems have standardized many types of key operated lock cylinders to allow interchangeability with various lock mechanism and adaptability to a variety of keying types and systems meeting requirements of security and convenience. The present invention furthers these goals of standardization and convenience of adapting to various keying systems by accepting and being operated by this unlimited variety of generic, standardized cylinders. This permits the padlock or groups of padlocks to be keyed alike, master-keyed or rekeyed in any manner, to be operated by keys compatible with other keying systems in general use, accomplishing goals of security and convenience by not requiring a separate key type for padlocks unless desired by the user. By incorporating a field selectable, dual function mechanism into such a universally adaptable padlock, no longer requiring two separate function padlocks to be inventoried, a much higher degree of standardization is achieved.

A further object of the invention is to provide a dual function padlock with an easy to use, dual function mechanism, a removable, re-keyable cylinder mechanism which does not affect the appearance or functioning of the padlock, which is simple to operate and service, which is inexpensive, which greatly enhances the security, convenience and safety features of the padlock to which it is applied, and which is otherwise particularly well suited for the purposes described. Further objects and advantages of the invention will become apparent from a consideration of the drawings and accompanying description thereof. Variations and modifications may be effective without departing from the spirit and scope of the novel concepts of this disclosure.

SUMMARY OF THE INVENTION

A padlock with removable cylinder mechanism offers the user a choice of two distinct manners of operation or "functions," a key retaining function and a non-key retaining function. This dual function capability in a single unit is achieved by a rotator bolt bored to allow placement of a pattern of pins. A series of pins, which when installed in the rotator bolt in a specified pattern, causes the function selection to be accomplished. A re-keyable padlock which accepts widely available, standard dimensioned, generic key operated lock cylinders allowing the keying of this padlock to be adapted to the wide range of keying systems used in locks found in residential, commercial and other uses as required for security and convenience. The use of standard dimensioned cylinders in the padlock is accomplished by a cylinder retainer, tailpiece stop and rotator bolt which adapts the generic cylinder to padlock use. The cylinder retainer, which retains the lock cylinder in the padlock body, is in turn held in the body by a threaded screw which is accessible through the short shackle leg opening in the body only when the shackle is in the unlocked condition and swung clear of its body opening. Upon removal of the threaded screw, the cylinder retainer and lock cylinder are removed from the body and the cylinder can be serviced or replaced. To replace the cylinder retainer and new lock cylinder, the procedure is reversed.

DETAILED DESCRIPTION OF THE PREFERRED EMBODIMENTS

Figure 1:
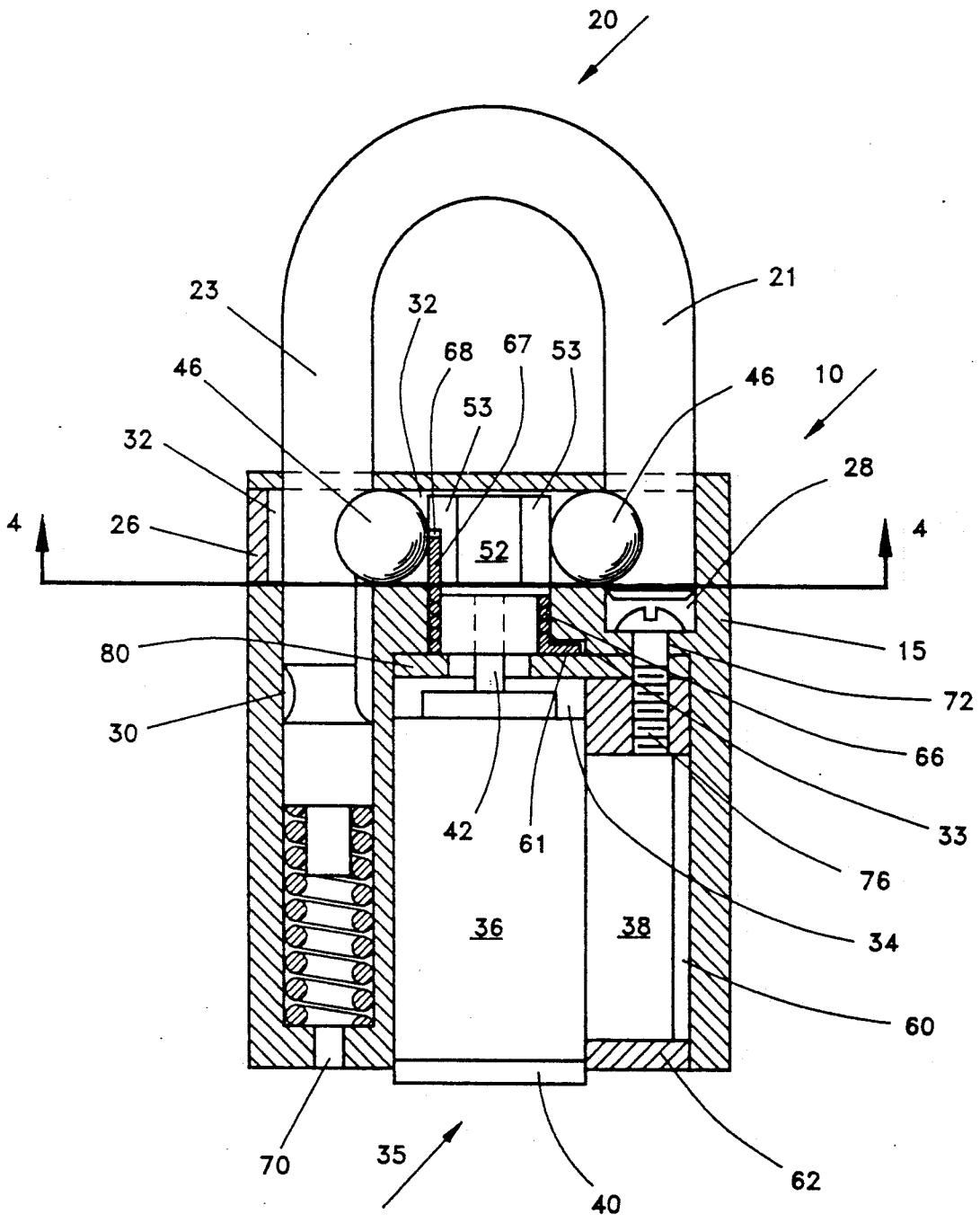
FIG. 1 shows a front sectional view of a padlock of the present invention with the shackle in its locked position.

In the embodiment of the invention illustrated in the drawings, the padlock of the present invention is shown generally at 10. It includes a body 15 having openings bored to accept various other parts. The shackle 20 is generally U-shaped in form and includes a short shackle leg 21 and a long shackle leg 23.

Entering from the top of the body 15 are two parallel bores; a shallow shackle bore 28 and a deep shackle bore 30 receiving, respectively, the short shackle leg 21 and the long shackle leg 23. A lateral opening 32 is provided toward the top of the body intersecting both the shallow bore 28 and the deep bore 30. The lateral opening 32 is sized to hold the locking balls 46 and to permit lateral movement of the locking balls 46 back and forth in the lateral opening 32 as Will be explained herein. A sealing plug 26 is inserted to close one end of the lateral opening 32.

The lower end of the body 15 has a cylinder opening 34 which receives a key operated lock cylinder 35 comprising a cylinder shell 36, a cylinder bible 38, a cylinder plug 40, and a cylinder tailpiece 42, all as is conventional in the art. The cylinder plug 40 has a cylinder keyway 41 opening into the bottom of the cylinder plug 40.

Figure 3:
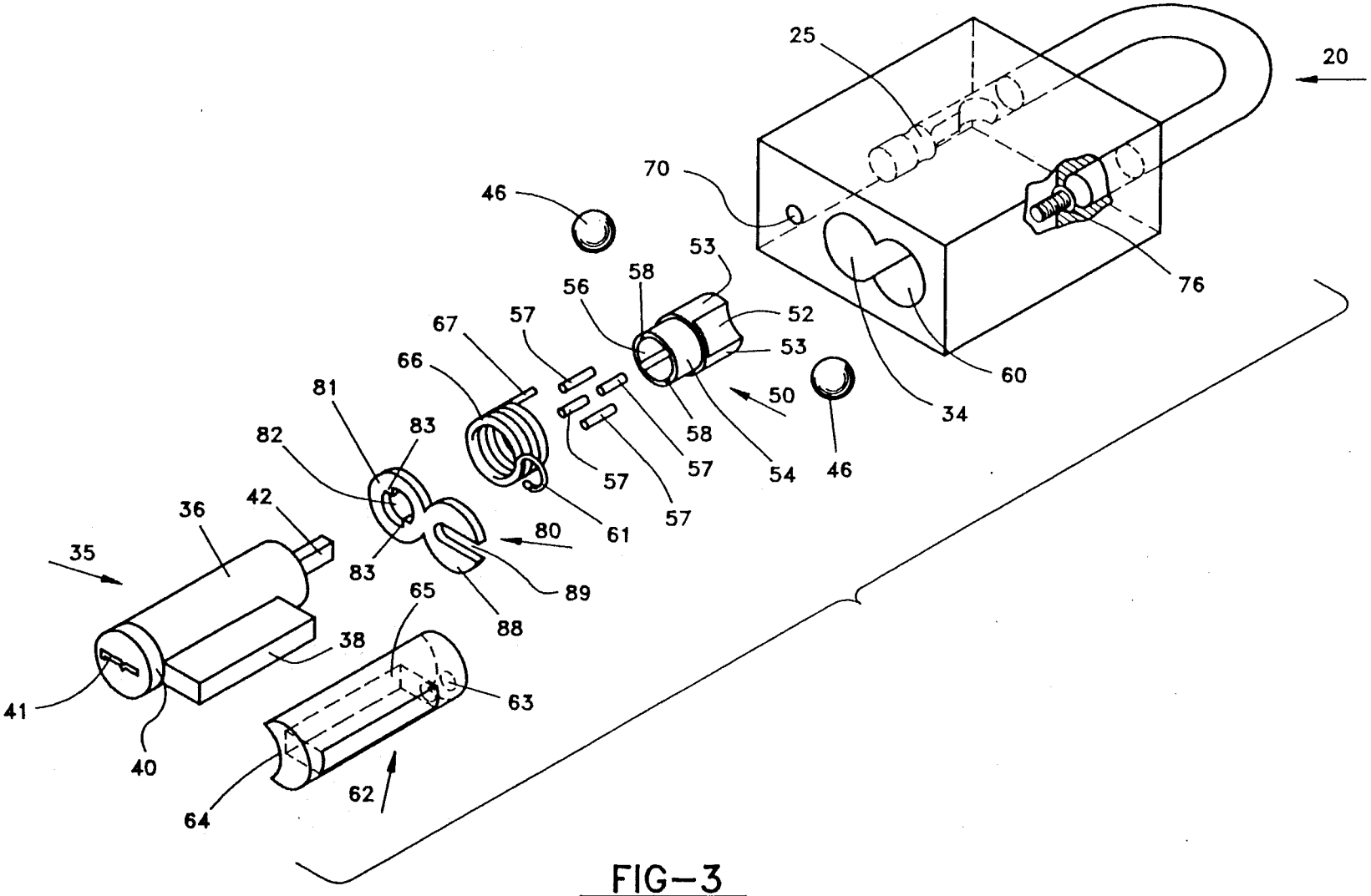
FIG. 3 is an exploded view of the padlock of the present invention.

Immediately adjacent to the cylinder opening 34 in the body is the cylinder retainer opening 60 which receives the cylinder retainer 62. The cylinder opening 34 and the cylinder retainer opening 60 intersect so that when viewed from the bottom of the body, the two holes form a "FIG. 8"0 shaped opening as shown in FIG. 3.

The cylinder retainer 62 is a cylindrically shaped piece with a radius cutout area 64, the radius of which matches the radius of the cylinder shell 36 of the lock cylinder 35. A retainer slot 65 is formed lengthwise in the cylinder retainer 62 sized to accept the cylinder bible 38 of the lock cylinder 35.

A compression spring 78 is located in the deep shackle bore 30. A drain aperture 70 is bored from the bottom of the deep shackle bore 30 to the outside of the body 15. The drain aperture 70 provides an outlet for debris and liquids to exit the body.

The lower end of the shallow shackle bore 28 is provided with an aperture 72 to receive the cylinder retaining screw 76. The upper end of the cylinder retainer 62 is also provided with a threaded aperture 63 which receives the lower end of the cylinder retaining screw 76.

Both the short shackle leg 21 and the long shackle leg 23 have radial recesses 22 and 24, respectively, that receive the locking balls 46 when the padlock is in the locked position. The long shackle leg 23 is formed with an annular groove 25.

The upper end of the cylinder opening 34 narrows in diameter to accept the rotator bolt 50. At the step created where the cylinder opening 34 narrows, a spring loop bore 33 is provided to accept the rotator spring loop 61 of the rotator torsion spring 66.

The rotator bolt 50 has two generally diametrically opposed radius cuts 52 formed on the periphery of the full diameter portion 53 of the rotator bolt 50. Each radius cut 52 engages with its respective locking ball 46 during the operation of the padlock 10 as will be more fully explained herein. The lower half of the rotator bolt 50 comprises a hollow lower extension 54 which is a smaller diameter than the upper half of the rotator bolt 50. The hollow lower extension 54 has a central bore 56 into which the cylinder tailpiece 42 will be placed when the padlock is assembled.

The central bore 56 is provided with four small recesses 58 located approximately 90° apart around the periphery of the central bore 56. Each recess 58 is sized to accept a rotator pin 57. In the preferred embodiment of the present invention, each rotator pin 57 is generally cylindrical in shape and is press fit into the correspondingly sized recess 58. Alternatively, pins of other cross sections, such as square, rectangular or oval, can be used and the pins Can be threaded, glued or otherwise secured into the recesses.

Figure 8:
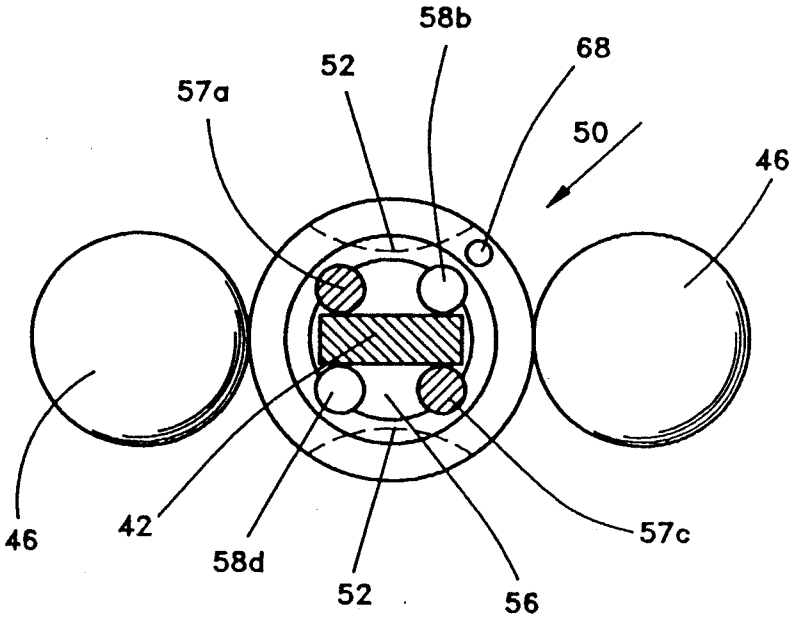
FIG. 8 is a view similar to FIG. 4 showing the padlock in a locked position with the rotator bolt configured for a non-key retaining function and utilizing a vertical tailpiece.

The tailpiece stop 80 is "figure-8" shaped with an "hour-glass" shaped aperture 82 formed in the first ring 81 and a slot 89 sized to permit passage of the cylinder retaining screw 76 formed in the second ring 88. The first ring 81 is provided with diametrically opposed flanges 83 that will engage the sides of the tailpiece 42 when the padlock is operated. The configuration of the aperture 82 with its opposed flanges 83 permits the tailpiece 42 to rotate only 90° when a key is turned in the cylinder keyway 41.

The assembly and operation of the padlock 10 will now be described. In the padlock's locked position shown in FIG. 1, the shackle 20 is held in the body 15 by the two locking balls 46 extending into radial recess 22 of the short shackle leg 21 and the radial recess 24 of the long shackle leg 23. The locking balls 46 are held in this extended locking position by the rotator bolt 50, the rotator bolt 50 having its full diameter portion 53 oriented towards the locking balls 46.

The rotator bolt 50 is retained in its location in the padlock 10 by the tailpiece stop 80, which is positioned flat against the bottom of the cylinder retainer opening 60. The lock cylinder bible 38 extends into the retainer slot 65 in the lock cylinder retainer 62; the radius cutout 64 allows the cylinder retainer 62 to sit flush against the lock cylinder shell 36. The cylinder retainer 62 seats against the second ring 88 of the tailpiece stop 80 and is held securely in that position by the Cylinder retaining screw 76. The cylinder retaining screw 76 is positioned at the bottom of the shallow shackle bore 28, extends through the aperture 72 of padlock body 15, then passes through the slot 89 in the second ring 88 of the tailpiece stop 80 and engages the threaded aperture 63 in the top face of the cylinder retainer 62 to accomplish the cylinder retaining function.

The lock cylinder tailpiece 42 passes through the "hour-glass" shaped aperture 82 in the first ring 81 of the tail-piece stop 80 and extends into the central bore 56 in the hollow lower extension 54 of the rotator bolt 50. Positioned in the small recesses 58 in the periphery of the hollow lower extension 54 of the rotator bolt 50 are the rotator pins 57.

When a properly bitted key is inserted into the cylinder keyway 41, the lock cylinder tumblers (not shown) located in the cylinder plug 40 and cylinder bible 38 align, as is standard in the art, and this alignment allows the cylinder plug 40 to rotate. Because the cylinder tailpiece 42 is fixed to the cylinder plug 40, the cylinder tailpiece 42 also rotates as the key rotates.

Because the cylinder tailpiece 42 extends into the central bore 56 in the hollow lower extension 54 of the rotator bolt 50, rotating the key causes the cylinder tail-piece 42 to engage the rotator pins 58 installed in the recesses 58 in the periphery of the central bore 56 of the rotator bolt 50. This rotation also causes the rotator bolt 50 to rotate.

When the rotator bolt 50 has been turned 90° clockwise, the opposed flanges 83 within the "hour-glass" shaped aperture 82 of the tailpiece stop 80, through which the cylinder tailpiece 42 passes, engage the cylinder tailpiece 42 and prevent further rotation of the cylinder tailpiece 42. During this 90° rotation of the rotator bolt 50, the rotator torsion spring 66 positioned by means of the spring loop 61 in the spring loop bore 33 within the body 15 is stretched into a biasing position because its rotator spring leg 67 is positioned within the spring leg bore 59.

Figure 2:
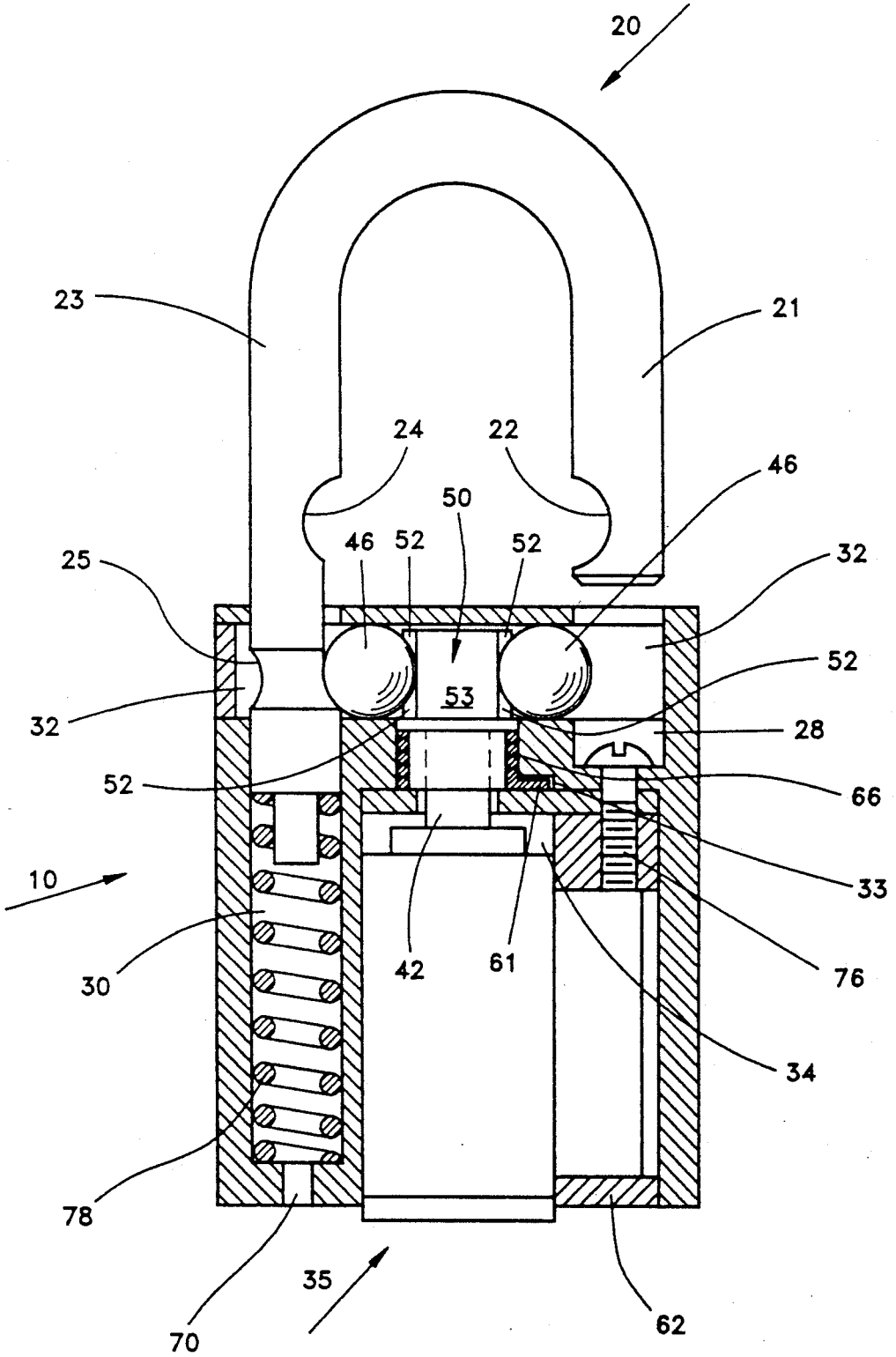
FIG. 2 shows a front sectional view of a padlock of the present invention with the shackle in its unlocked position.

When the rotator bolt 50 reaches its full 90° rotation, the radius cuts 52 on the full diameter portion 53 of the rotator bolt 50 are now aligned with the locking balls 46. The compression spring 78, seated in the deep shackle bore 24, biases the shackle 20 upward. The bias also forces the locking balls 46 to travel inward into the radius cuts 52 of the rotator bolt 50. When the inward movement of the locking balls 46 is sufficient to clear recesses 22 and 24 of the shackle legs 21 and 23, the compression spring 78 moves the shackle 20 to the open or unlocked position as shown in FIG. 2.

To lock the padlock 10, the shackle 20 is pushed into the padlock body 15. When the shackle recesses 22 and 24 become opposite the locking balls 46, the rotator torsion spring 66, which was biased during unlocking of the padlock 10, forces the rotator bolt 50 to rotate, which causes the locking balls 46 to travel outward away from the radius cuts 52 in the rotator bolt 50 and into the shackle recesses 22 and 24. This locks the padlock.

Should it be desired to obtain access to the lock cylinder 35 for the purpose of removing it for replacement or servicing, it is merely necessary to insert a properly bitted key into the presently installed cylinder 35 and unlock the shackle 20. The short shackle leg 21 can then be swung clear of its shallow shackle bore 28, thereby providing access to the cylinder retaining screw 76. The screw 76 may be unthreaded relative to the cylinder retainer 62 and removed therefrom. Once the screw 76 is removed, the key operated lock cylinder 35, along with the cylinder retainer 62 may be removed from the bottom of the body 15 as a unit. The cylinder retainer 62 is separated from the lock cylinder 35 by simply sliding it apart. After the lock cylinder 35 is serviced, or a replacement cylinder is selected, assembly into the padlock body 15 is accomplished in the reverse manner.

Once reassembled, the padlock 10 is fully operative and ready to return to service.

The standard dimensioned conventional lock cylinders that would be utilized with this padlock are furnished optionally with either a vertically installed cylinder tailpiece or a horizontally installed cylinder tailpiece. The padlock of the present invention is designed to be able to accommodate either of these types of conventional lock cylinders in either a Key Retaining function or a Non-Key Retaining function.

The padlock of the present invention Can be arranged by suitable orientation of the parts of the padlock so that the padlock can function either as a Key-Retaining padlock or a Non-Key Retaining padlock and either utilizing a generic lock cylinder which is furnished with a vertically installed tailpiece or a horizontally installed tailpiece.

The choices of operation will now be described:

A: Key Retaining (KR) function operated by a lock cylinder 35 with a vertically installed tailpiece 42

Figure 5:
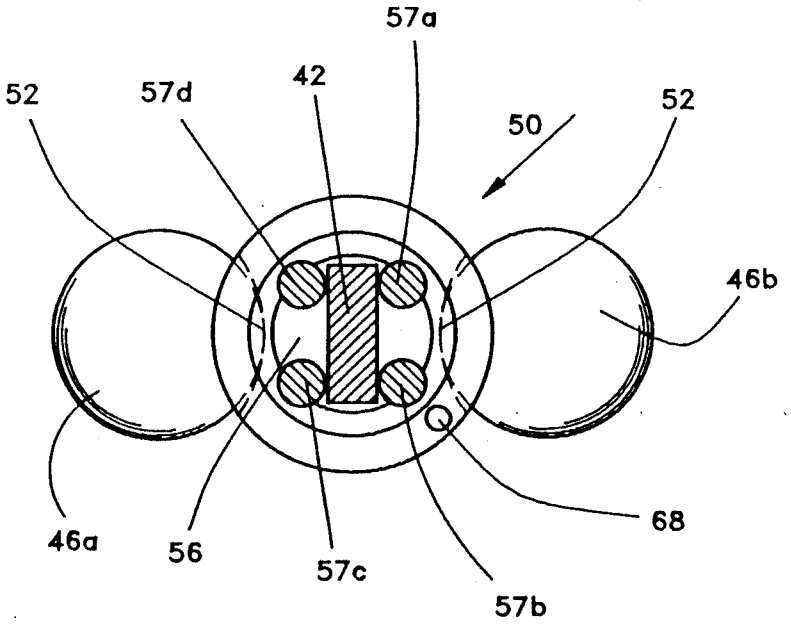
FIG. 5 is a view similar to FIG. 4 showing the padlock in an unlocked position with the rotator bolt turned 90° and configured for a key retaining function and utilizing a vertical tailpiece.
Figure 4:
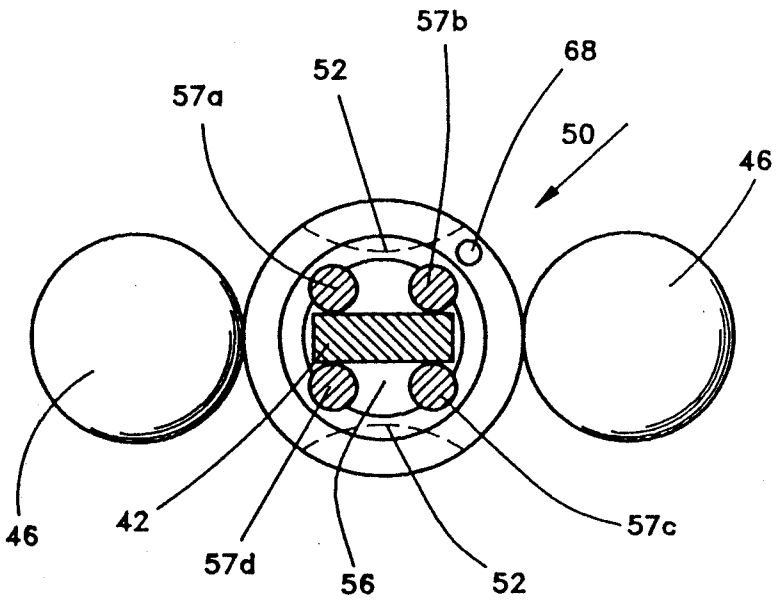
FIG. 4 is a sectional view taken along line 4—4 of FIG. 1 showing the padlock in a locked position with the rotator bolt configured for a key retaining function and utilizing a vertical tailpiece.

The rotator bolt 50 is provided with a central bore 56 in its lower end to accept the lock cylinder tailpiece 42 which in FIGS. 4 and 5 is shown as a vertically installed tail-piece. Referring to FIG. 4, shown is a bottom view of the rotator bolt 50. Around the periphery of the central bore 56 is a square pattern formed by four small recesses 58 which are bored to accept rotator pins 57. Rotator pins 57A, 57B, 57C and 57D are placed in all four recesses 58. When a lock cylinder 35 with a tailpiece 42 installed in the vertical position is installed in the padlock 10 and the key is rotated clockwise, the tailpiece 42 engages the rotator pins 57 which causes the rotator bolt 50 to rotate to the unlocked position shown in FIG. 5. This aligns the radius cuts 52 of the rotator bolt 50 with the locking balls 46, which allows the padlock 10 to unlock as previously described.

While the padlock 10 remains unlocked, the left-hand locking ball 46A is forcibly held into its corresponding radius cut 52 of the rotator bolt 50 by the long shackle leg 23. With the rotator bolt 50 held in this unlocked position, after being rotated clockwise by the cylinder tailpiece 42 engaging the rotator pins 57A and 57C, the presence of rotator pins 57B and 57D in the other two recesses prevents the cylinder tailpiece 42 from rotating counter-clockwise. This prevents the key from being removed from the lock cylinder 35 until the padlock shackle 20 is returned to the locked position, thus achieving a Key Retaining function. In this function, the rotator torsion spring 66 is not necessary to the operation of the padlock because the rotation of the rotator bolt 50 in both the clockwise and the counter-clockwise directions is effected by direct drive of the tailpiece 42.

B: Key Retaining (KR) function operated by lock cylinder 42 with a horizontally installed tailpiece 42

Figure 7:
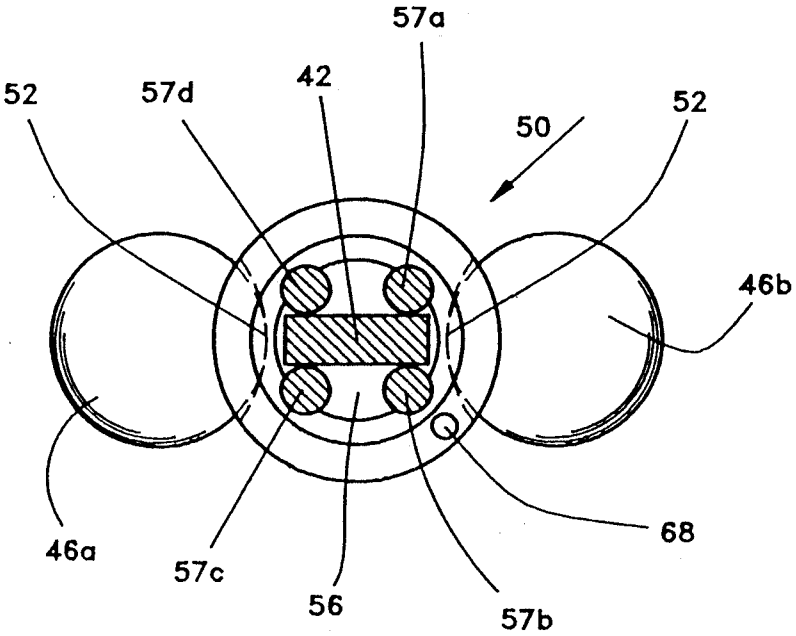
FIG. 7 is a view similar to FIG. 6 showing the padlock in an unlocked position with the rotator bolt turned 90° and configured for a key retaining function and utilizing a horizontal tailpiece.
Figure 6:
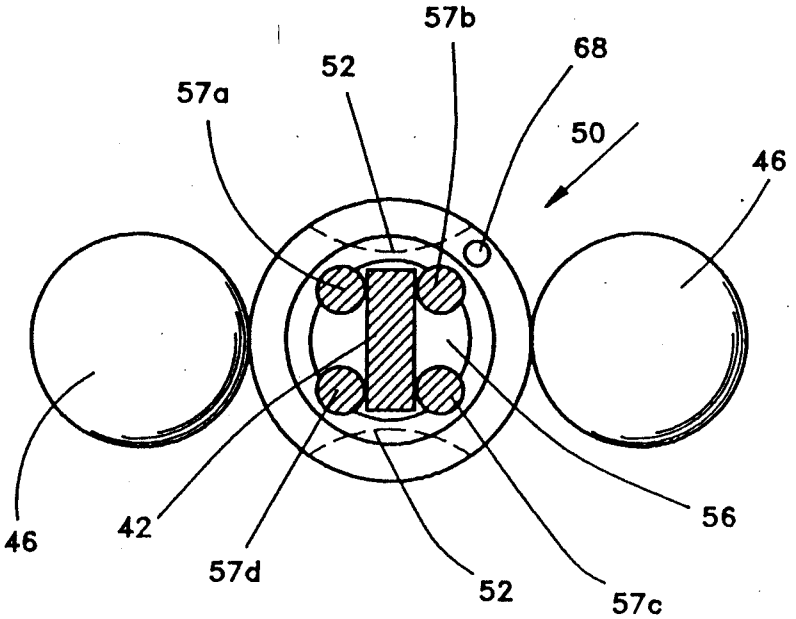
FIG. 6 is a view similar to FIG. 4 showing the padlock in a locked position with the rotator bolt configured for a key retaining function and utilizing a horizontal tail-piece.

The rotator bolt 50 is provided with a central bore 56 in its lower end to accept the lock cylinder tailpiece 42 which in FIGS. 6 and 7 is shown as a horizontally installed tailpiece. Referring to FIG. 6, shown is a bottom view of the rotator bolt 50. Around the periphery of the central bore 56 is a square pattern formed by four small recesses 58 Which are bored to accept rotator pins 57. Rotator pins 57A, 57B, 57C and 57D are placed in all four recesses 58. When a lock cylinder 35 with a tailpiece 42 installed in the horizontal position is installed in the padlock 10 and the key is rotated clockwise, the tailpiece 42 engages the rotator pins 57 which causes the rotator bolt 50 to rotate to the unlocked position shown in FIG. 7. This aligns the radius cuts 52 of the rotator bolt 50 with the locking balls 46, which allows the padlock 10 to unlock as previously described.

While the padlock 10 remains unlocked, the left-hand locking ball 46A is forcibly held into its corresponding radius cut 52 of the rotator bolt 50 by the long shackle leg 23. With the rotator bolt 50 held in this unlocked position, after being rotated clockwise by the cylinder tailpiece 42 engaging the rotator pins 57B and 57D, the presence of rotator pins 57A and 57C in the other two recesses prevents the cylinder tailpiece 42 from rotating counter-clockwise. This prevents the key from being removed from the lock cylinder 35 until the padlock shackle 20 is returned to the locked position, thus achieving a Key Retaining function. In this function, the rotator torsion spring 66 is not necessary to the operation of the padlock because the rotation of the rotator bolt 50 in both the clockwise and the counter-clockwise directions is effected by direct drive of the tailpiece 42.

C: Retaining (NKR) function operated by a lock cylinder 35 with a vertically installed tailpiece 42

Figure 9:
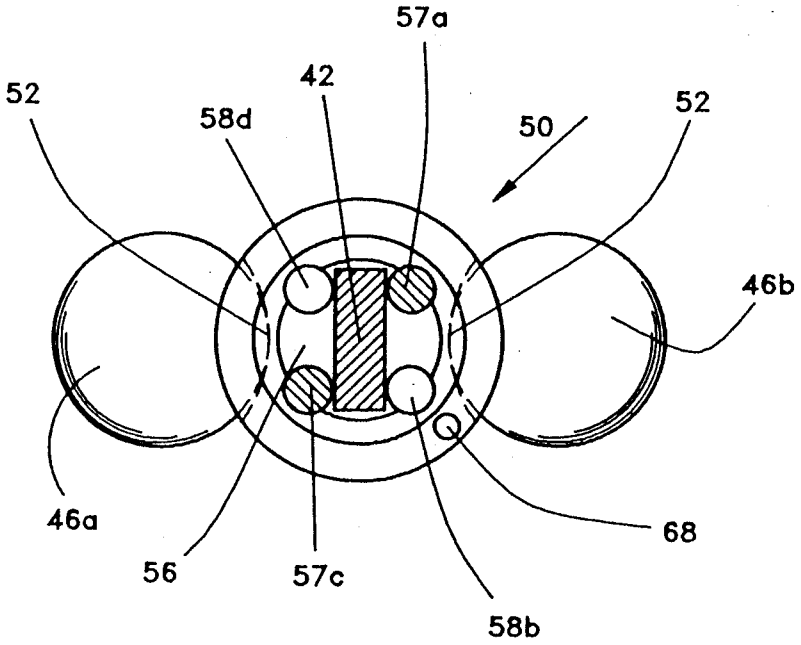
FIG. 9 is a view similar to FIG. 8 showing the padlock in an unlocked position with the rotator bolt turned 90° and configured for a non-key retaining function and utilizing a vertical tailpiece.

The rotator bolt 50 is provided with a central bore 56 in its lower end to accept the lock cylinder tailpiece 42 which in FIGS. 8 and 9 is shown as a vertically installed tail-piece. Referring to FIG. 8, shown is a bottom view of the rotator bolt 50. Around the periphery of the central bore 56 is a square pattern formed by four small recesses 58 which are bored to accept rotator pins 57. Rotator pins 57A and 57C are placed in two of the recesses 58 while the other two recesses 58B and 58D remain empty.

When rotator pins 57A and 57C are thus installed, a tailpiece 42 installed in the vertical position engages the rotator pins 57A and 57C when the key is rotated clockwise to the unlocked position shown in FIG. 9. This causes the rotator bolt 50 to rotate, thus energizing the rotator torsion spring 66, thus aligning the radius cuts 52 of the rotator bolt 50 with the locking balls 46, which allows the padlock 10 to unlock as previously described.

While the padlock 10 remains unlocked, the left-hand locking ball 46A is forcibly held into its corresponding radius cut 52 of the rotator bolt 50 by the long shackle leg 23. With the rotator bolt 50 held in this unlocked position, after being rotated clockwise by the cylinder tailpiece 42 engaging the rotator pins 57A and 57C, the absence of rotator pins 57 in the other two recesses 58B and 58D allows the cylinder tailpiece 42 to rotate counter-clockwise, returning to its original position, allowing the key to be removed from the lock cylinder 35, thus achieving a Non-Key retaining D: Non-Key Retaining (NKR) function operated by a lock cylinder 35 with a horizontally installed tailpiece 42

Figure 11:
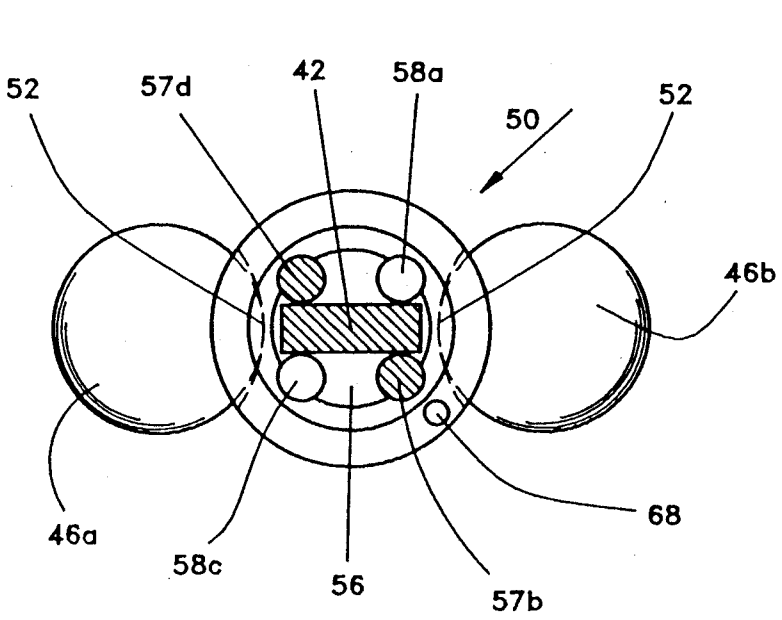
FIG. 11 is a view similar to FIG. 10 showing the padlock in an unlocked position with the rotator bolt turned 90° and configured for a non-key retaining function and utilizing a horizontal tailpiece.
Figure 10:
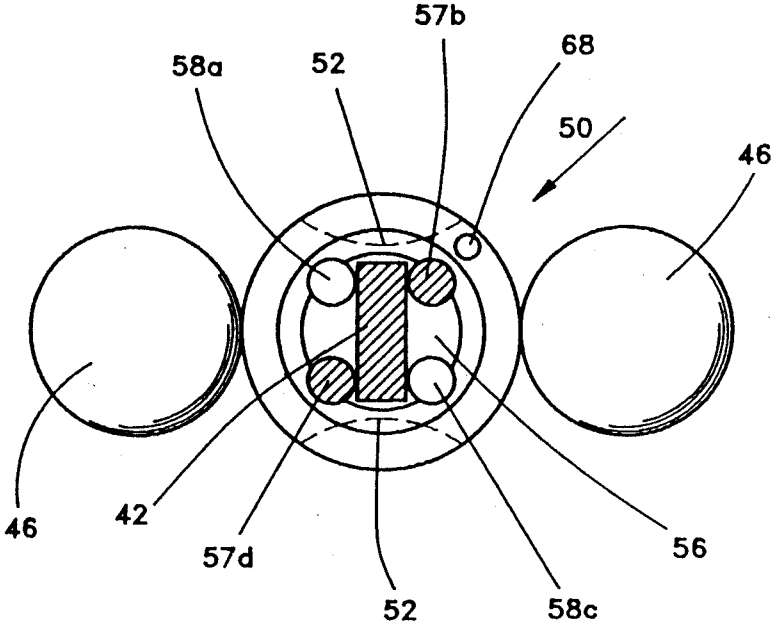
FIG. 10 is a view similar to FIG. 4 showing the padlock in a locked position with the rotator bolt configured for a non-key retaining function and utilizing a horizontal tailpiece.

The rotator bolt 50 is provided with a central bore 56 to accept the lock cylinder tailpiece 42 which in FIGS. 10 and 11 is shown as a horizontally installed tailpiece. Referring to FIG. 10, shown is a bottom view of the rotator bolt 50. Around the periphery of the central bore 56 is a square pattern formed by four small recesses 58 which are bored to accept rotator pins 57. Rotator pins 57B and 57D are placed in two of the recesses while the other two recesses 58A and 58 remain empty.

When rotator pins 57B and 57D are thus installed, a tail-piece 42 installed in the horizontal position engages the rotator pins 57B and 57D when the key is rotated clockwise to the unlocked position shown in FIG. 11. This causes the rotator bolt 50 to rotate, thus energizing the rotator torsion spring 66, thus aligning the radius cuts 52 of the rotator bolt 50 with the locking balls 46, Which allows the padlock 10 to unlock as previously described.

While the padlock 10 remains unlocked, the left-hand locking ball 46A is forcibly held into its corresponding radius cut 52 of the rotator bolt 50 by the long shackle leg 23. With the rotator bolt 50 held in this unlocked position, after being rotated clockwise by the cylinder tailpiece 42 engaging the rotator pins 57B and 57D, the absence of rotator pins 57 in the other two recesses 58A and 58C allows the cylinder tailpiece 42 to rotate counter-clockwise, returning to its original position, allowing the key to be removed from the lock cylinder 35, thus achieving a Non-Key Retaining Function.

Thus the placement of rotator pins 57 in the specified recesses 58 of the rotator bolt 50 allows lock cylinders 35 with either a vertical tailpiece 42 or a horizontal tailpiece 42 to be installed, while achieving either a Non-Key Retaining (NKR) function or a Key-Retaining (KR) function.

Figure 13:
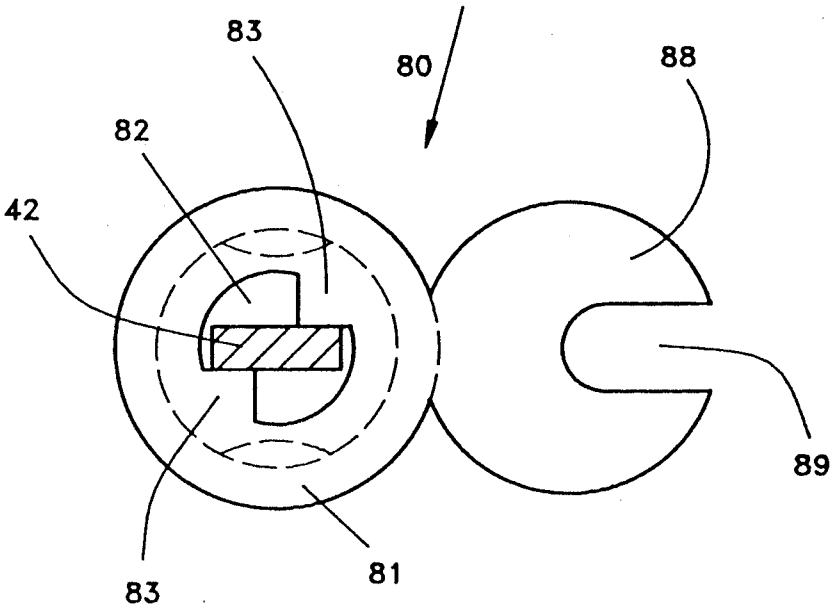
FIG. 13 is a view of the tailpiece stop of the present invention configured to operate with a vertical tailpiece.
Figure 12:
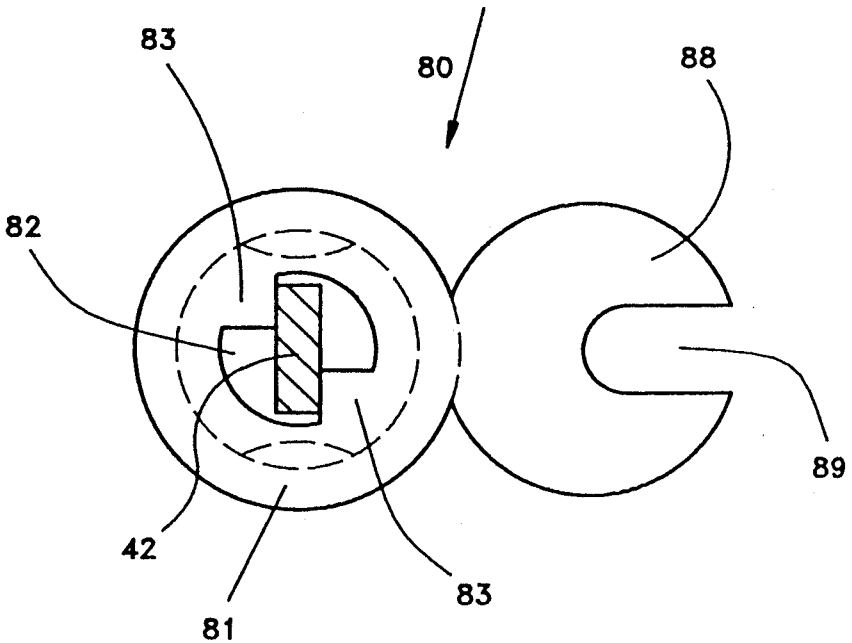
FIG. 12 is a view of the tailpiece stop of the present invention configured to operate with a horizontal tailpiece.

Further as shown in FIGS. 12 and 13, the tailpiece stop 80 may be installed to receive the tailpiece 42 in either a horizontal orientation (FIG. 12) or a vertical orientation (FIG. 13). In order to convert a padlock from one tailpiece orientation to the other, it is only necessary to flip-flop the tailpiece stop 80 180° thus reorienting the position of the opposed flanges 83. This reorientation provides the appropriate location for the 90° rotational turn required for either the vertical or the horizontal cylinder tailpiece installation. This design further contributes to the adaptability, convenience and universal application of this invention.

Many variations of the present invention are possible; for example, the invention can accommodate padlock bodies of various shapes, cylinder retainers as appropriate for differing cylinders or shackles of various lengths. Likewise, the rotator pins 57 could be mounted in the end of the lock cylinder 36 and the tail piece 42 could be mounted in the interior of the hollow lower extension 54 of the rotator bolt 50.

While the invention has been illustrated with respect to several specific embodiments thereof, these embodiments should be considered as illustrative rather than limiting. Various modifications and additions may be made and will be apparent to those skilled in the art. Accordingly, the invention should not be limited by the foregoing description, but rather should be defined only by the following claims.

What is claimed is:

1. A padlock comprising:

a) a padlock body, b) a shackle including a long shackle leg and a short shackle leg mounted within the padlock body, c) a pair of locking balls disposed within the padlock body, each locking ball disposed to engage a recess in a shackle leg when the padlock is in a locked position, d) a lock cylinder mounted within the padlock body, the lock cylinder including a tailpiece, e) a rotator bolt mounted within the padlock body adjacent the tailpiece, the rotator bolt including a full diameter portion that engages the locking balls and pushes the locking balls into the recess in each shackle leg when the padlock is in the locked position and the rotator bolt including a pair of radius cuts in the upper section that receive the locking balls when the padlock is in the unlocked position, and f) the rotator bolt further including a hollow lower extension which receives the tailpiece of the lock cylinder and a plurality of pins selectively mounted to the interior of the hollow lower extension whereby the padlock can be configured to accommodate either a vertical or a horizontal tail-piece in either a key-retaining or non-key-retaining function by selective removal of at least one pin.

2. The padlock of claim 1 further including a tailpiece stop disposed between the lock cylinder and the rotator bolt, the tailpiece stop having an aperture through which the tailpiece extends and at least one flange that limits the rotation of the tailpiece.

3. The padlock of claim 1 wherein the tailpiece stop comprises:

a) a first ring having a central aperture and a pair of flanges that extend into the aperture to limit the rotation of the tailpiece and b) a second ring laterally attached to the first ring and including a slot therein whereby the tailpiece stop can be secured in the padlock body.

4. The padlock of claim 1 wherein the hollow lower extension includes a plurality of recesses located around its periphery and the pins are selectively mounted in at least two of the recesses so that the hollow lower extension can accommodate either a vertical or a horizontal tailpiece in either a key-retaining or non-key-retaining function.

5. The padlock of claim 4 wherein four recesses are located approximately 90° apart around the periphery of the hollow lower extension and two pins are provided in diametrically opposed recesses so that the hollow lower extension can accommodate either a vertical or a horizontal tailpiece in a non-key-retaining function.

6. The padlock of claim 1 wherein four pins are located approximately 90° apart around the periphery of the hollow lower extension so that the hollow lower extension can accommodate either a vertical or a horizontal tailpiece in a key-retaining function.

7. A padlock comprising:

a) a padlock body, b) a shackle including at least one shackle leg mounted within the padlock body, c) at least one locking ball disposed within the padlock body, the locking ball disposed to engage a recess in the shackle leg when the padlock is in a locked position, d) a lock cylinder mounted within the padlock body, the lock cylinder including a tailpiece, e) a rotator bolt mounted within the padlock body adjacent the tailpiece, the rotator bolt including a full diameter portion that engages the locking ball and pushes the locking ball into the recess in the shackle leg when the padlock is in the locked position and the rotator bolt including at least one radius cut in the upper section that receives the locking ball when the padlock is in the unlocked position, and f) the rotator bolt further including a hollow lower extension which receives the tailpiece of the lock cylinder and at least one pin selectively mounted to the interior of the hollow lower extension whereby the padlock can be configured to accommodate either a vertical or a horizontal tail-piece in either a key-retaining or non-key-retaining function by selective removal of at least one pin.

8. The padlock of claim 7 further including a tailpiece stop disposed between the lock cylinder and the rotator bolt, the tailpiece stop having an aperture through which the tailpiece extends and at least one flange that limits the rotation of the tailpiece.

9. The padlock of claim 7 wherein the tailpiece stop comprises:

a) a first ring having a central aperture and a pair of flanges that extend into the aperture to limit the rotation of the tailpiece and b) a second ring laterally attached to the first ring and including a slot therein whereby the tailpiece stop can be secured in the padlock body.

10. A padlock comprising:

a) a padlock body, b) a lock cylinder mounted within the padlock body, the lock cylinder including a tailpiece, c) a rotator bolt mounted within the padlock body adjacent the tailpiece, and f) the rotator bolt further including a hollow lower extension which receives the tailpiece of the lock cylinder and a plurality of pins selectively mounted to the interior of the hollow lower extension whereby the padlock can be configured to accommodate either a vertical or a horizontal tailpiece in either a key-retaining or non-key-retaining function by selective removal of at least one pin.

11. The padlock of claim 10 further including a tailpiece stop disposed between the lock cylinder and the rotator bolt, the tailpiece stop having an aperture through which the tailpiece extends and at least one flange that limits the rotation of the tailpiece.

12. The padlock of claim 10 wherein the tailpiece stop comprises:

a) a first ring having a central aperture and a pair of flanges that extend into the aperture to limit the rotation of the tailpiece and b) a second ring laterally attached to the first ring and including a slot therein whereby the tailpiece stop can be secured in the padlock body.

* * * * *